US006283011B1

(12) United States Patent
Assumel-Lurdin

(10) Patent No.: US 6,283,011 B1
(45) Date of Patent: Sep. 4, 2001

(54) CYLINDER WITH AN ELASTIC DEVICE FOR RETURNING A WORKING PISTON UNIT TO A NEUTRAL POSITION

(75) Inventor: Ludovic Assumel-Lurdin, Saint Sylvain d'Anjou (FR)

(73) Assignee: ARO (FR)

( * ) Notice: Subject to any disclaimer, the term of this patent is extended or adjusted under 35 U.S.C. 154(b) by 0 days.

(21) Appl. No.: 09/421,764

(22) Filed: Oct. 19, 1999

(30) Foreign Application Priority Data

Oct. 28, 1998 (FR) ..... 98 13509

(51) Int. Cl.[7] ..... F01B 31/00
(52) U.S. Cl. ..... 92/134
(58) Field of Search ..... 92/130 B, 130 C, 92/134

(56) References Cited

U.S. PATENT DOCUMENTS

| | | | | |
|---|---|---|---|---|
| 380,375 | * | 4/1888 | Williams et al. | 92/137 |
| 1,786,474 | * | 12/1930 | Bickel | 92/130 C X |
| 2,092,580 | * | 9/1937 | Kelley | 92/130 C X |
| 3,672,402 | * | 6/1972 | Bloemer | 92/134 X |
| 3,752,161 | | 8/1973 | Bent . | |
| 3,834,276 | | 9/1974 | Gournelle . | |
| 4,226,167 | * | 10/1980 | Lew | 92/134 X |
| 5,125,326 | | 6/1992 | Sacona . | |

FOREIGN PATENT DOCUMENTS

| | | | |
|---|---|---|---|
| 2 673 983 | | 9/1992 | (FR) . |
| 2 721 359 | | 12/1995 | (FR) . |
| 3330 | * | 4/2000 | (GB) ..... 92/134 |

* cited by examiner

*Primary Examiner*—John E. Ryznic
(74) *Attorney, Agent, or Firm*—Piper Marbury Rudnick & Wolfe

(57) ABSTRACT

This cylinder, which may be entirely pneumatic, has two working pistons 26 and 27 linked to a working rod 28, slidably mounted on which are two small auxiliary pistons 37 and 38 which can be displaced in an auxiliary chamber 35. The latter, being permanently supplied with a compressed gas, can cause the return, by means of the piston 38 or 37, of the fitting 26-27-28 to an intermediate position shown in the drawing, respectively from a fully extracted position (towards the right) of the rod 28 or a fully retracted position (to the left) of this rod.

7 Claims, 3 Drawing Sheets

Figure 1:
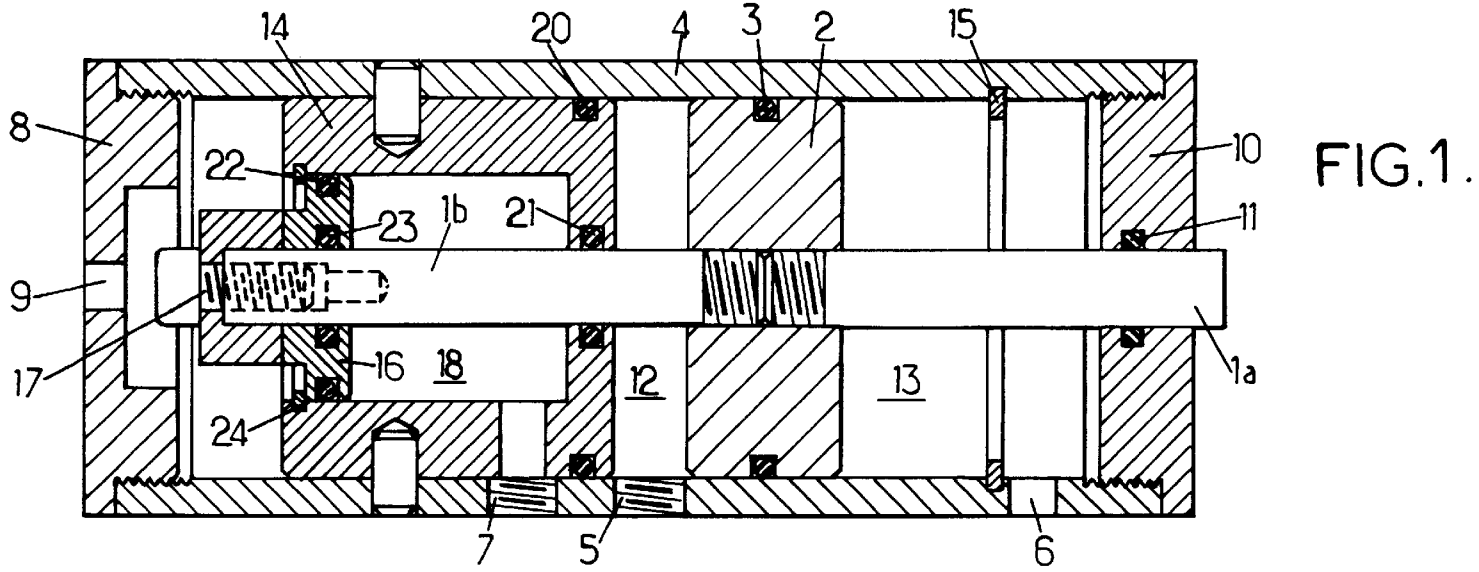

10
11
1a
6
15
13
2
3
4
12
5
20
21
7
1b
18
23
16
14
22
24
8
9
17

1a
10
11
6
15
3
2
4
1b
12
5
7
14
9
8

CYLINDER WITH AN ELASTIC DEVICE FOR RETURNING A WORKING PISTON UNIT TO A NEUTRAL POSITION

The present invention relates to a cylinder with an elastic device for returning a working piston unit to a neutral position, this piston unit being attached to a working rod and mounted in at least one working chamber so that it slides between a rest position and a working position, said neutral position being between these two positions or coinciding with the rest position.

The operating part of this cylinder may be hydraulic or pneumatic, depending on the applications in which it is used and the amount of working force to be produced. The working rod may be connected to any type of tool, for example a clamp with arms or jaws articulated at X or at C and provided with electrodes for resistance spot-welding. With this type of welding, the workpieces to be welded may be fixed relative to the ground whilst the welding clamp is carried by the operator.

A welding clamp of this type is described in French patent application No. 98.08752 filed in the name of this applicant, for example, to which reference may be made for further details. In principle, the electrodes are clamped onto the workpieces to be welded, which corresponds to the working position mentioned above, following an initial approach pass of the tool which is in effect a wide-open position in readiness for the first assembly to be performed (wide-open position which can be regarded as corresponding to the rest position mentioned above) and a positioning of the tool to a neutral position, for example an intermediate position, in readiness for subsequent assemblies. In practice, the constraints inherent in the welding range make it necessary to operate with a three-position cylinder enabling the jaw to be opened wide (so-called "rest position"), particularly when engaging and retracting the arms of the tools relative to the workpieces to be welded, closing down to a neutral or intermediate point as the arms approach the point to be welded and closure applied by a high force during the welding cycle (so-called "working" position). In order to save time during the welding cycle, the neutral or intermediate position must be such that it can be used as a small opening to avoid having to fully re-open the clamp.

Furthermore, a known approach to ensuring that the working piston unit is returned to a neutral or intermediate position in such cylinders is to subject this piston to the antagonistic forces of one or two return springs.

The disadvantage of a mechanical return design of this type is that the welding force is dependent on the number of pistons mounted, their sections and the return coefficient of the springs back to the neutral or intermediate position. The higher the return coefficients, the higher the positioning speed at the neutral or intermediate point but the lower the clamping force and the lower the opening speed and vice versa.

Furthermore, if a clamp with a multi-stage cylinder is used, a higher number of and more complex control members and associated logics are needed the greater the number and complexity of the chambers to be pressurised or exhausted, which means more control cables, a more complex control logic and a heavier clamp, thereby rendering this tool useless as a portable unit.

The objective of this invention is to eliminate the disadvantages of the prior art and to this end, a cylinder as proposed by the invention, of the type defined above, is characterised in that the elastic device for returning said working piston to a neutral or intermediate position is of the pneumatic type and operates an auxiliary piston unit with a relatively small section, slidably mounted in an auxiliary chamber which is pneumatically supplied independently of that which operates said working piston unit.

Advantageously, said elastic device has at least one auxiliary piston unit connected to said working piston unit and slidably mounted in an auxiliary chamber, this auxiliary piston unit being designed to be displaced inside said auxiliary chamber in one direction or the other by said working piston unit when the latter is displaced between its rest position and its working position or vice versa, and to elastically compress a gas inside said auxiliary chamber so as to be able to return said working piston unit elastically into said neutral or intermediate position.

As will be seen below, the invention may be used with a "working piston unit" comprising one or more working pistons, depending on the working force required during clamping. If, for example, there are two working pistons, the "auxiliary piston unit" of the elastic device will have one or more auxiliary pistons, located between the two working pistons, and designed to return these latter to a neutral position or intermediate small opening between the wide-open position and the clamped position of a welding clamp.

Figure 2:
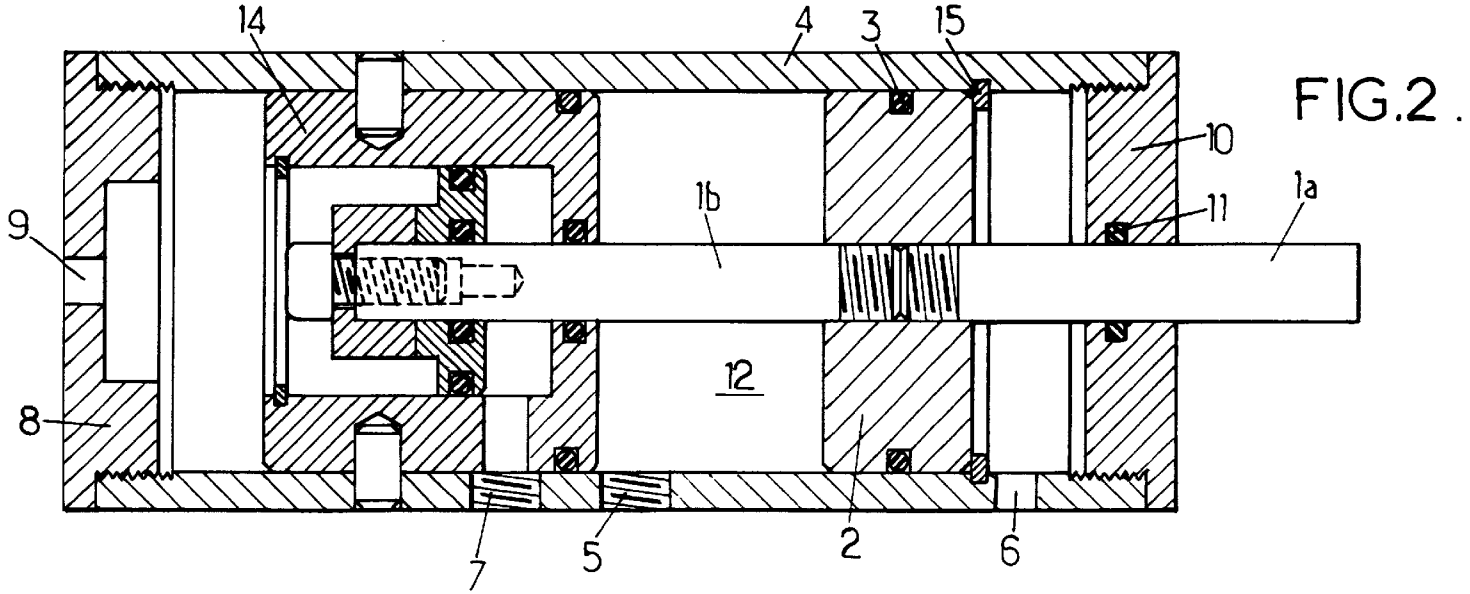
Figure 3:
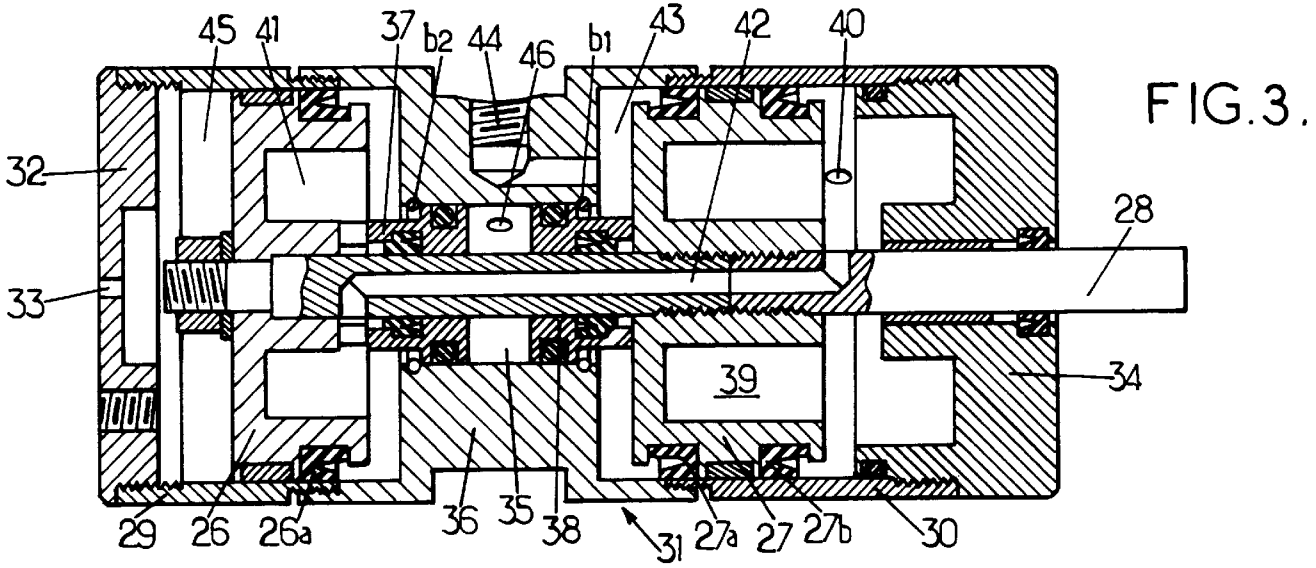
Figure 4:
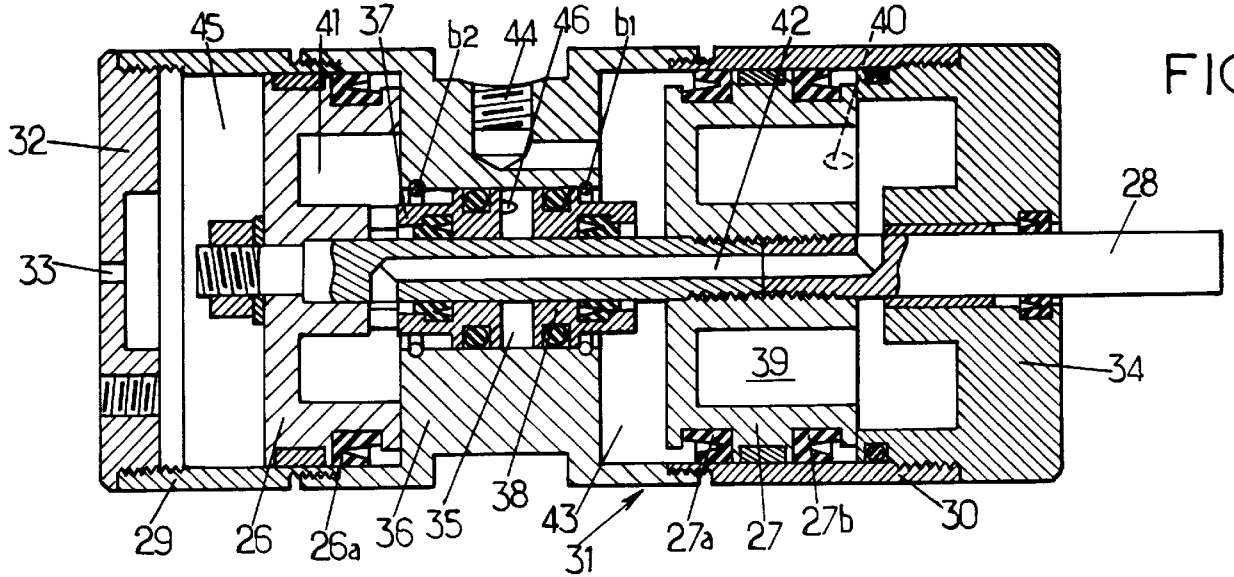
Figure 5:
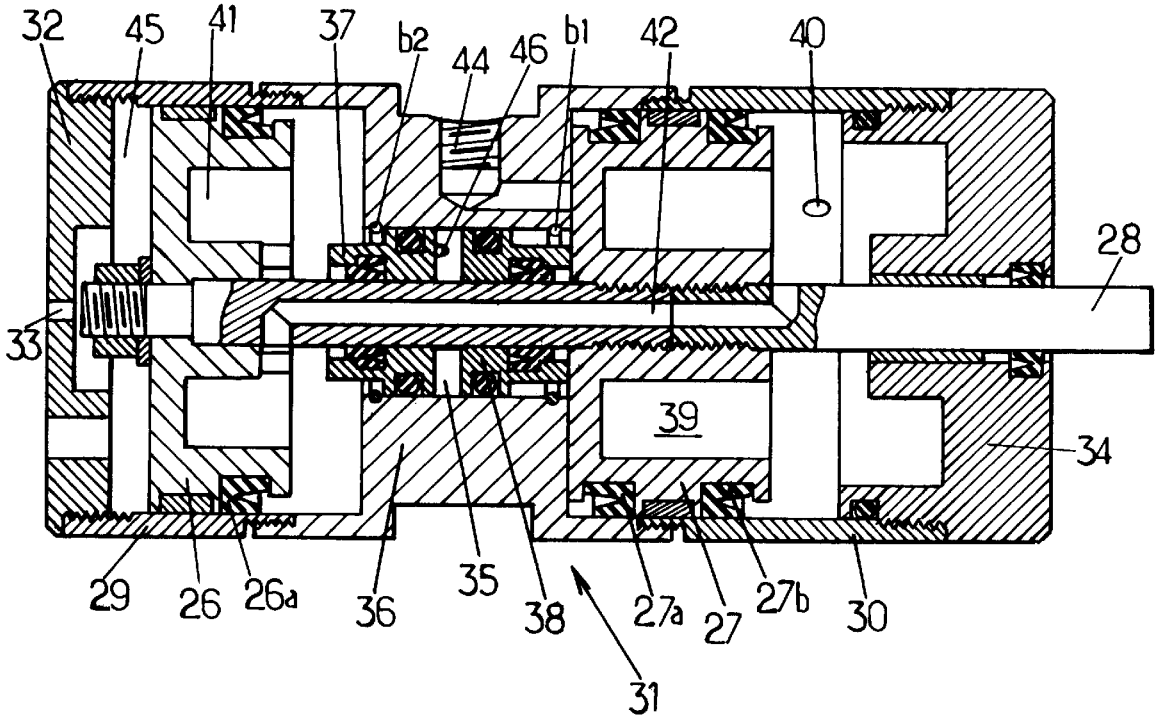

Two modes of implementing the invention will now be described by way of example, although these are not restrictive, the first relating to any application and the second as applied to a welding clamp, given with reference to the appended drawings, of which:

FIGS. 1 and 2 are views in axial section of a cylinder with a pneumatic return as proposed by the invention, shown respectively in one and the other of its two operating positions; and FIGS. 3 to 5 are an axial section of another pneumatic return cylinder as proposed by the invention, operation of which involves passing through three positions: rest, intermediate and working, for example in order to activate a three-position welding clamp: respectively fully open (FIG. 4), small opening (FIG. 3) and clamped (FIG. 5) on the sheets to be welded.

The cylinder, which is an air cylinder for example, illustrated in FIGS. 1 and 2 has a working rod in two sections 1*a*–1*b*, attached by any appropriate means, for example by an end screw, to a working piston 2 provided with an O-ring seal 3 and designed to slide inside a power cylinder 4 through which passages are provided for supplying 5 and 7 and exhausting 6 compressed air. The ends of the power cylinder are closed off by two threaded plugs: a plug 8 with a vent hole 9 and a plug 10 of which a central bore is provided with an O-ring seal 11 to provide a sealed passage for the rod section 1*a* of the working rod, which projects to the exterior in order to activate a tool of any type. The working piston 2 therefore divides the working chamber of the power cylinder 4 into two compartments: a compartment 12 linking into the passage 5 and formed between the piston 2 and a fixed mount 14 of the cylinder and a compartment 13 (FIG. 1) linking into the exhaust passage 6 and formed between the piston 2 and a stop circlip 15.

This cylinder also has an auxiliary piston 16 attached at the end by a gudgeon 17 onto the section 1*b* of the working rod and slidably mounted in a chamber 18 of the mount 14, which has a lateral passage 19 placing it in permanent communication with the above-mentioned passage 7 of the power cylinder 4. The mount 14 is provided with O-ring seals 20 and 21 to provide a seal respectively on a level with the internal wall of the cylinder 4 and on a level with the section 1*b* of the working rod, whilst the auxiliary piston 16 is similarly provided with O-ring seals 22 and 23 to provide a seal respectively on a level with the internal wall of the chamber 18 and on a level with the section 1*b* of the working rod. Finally, a circlip 24 restricts the displacement of the auxiliary piston 16 in the chamber 18 towards the left-hand side.

This being the case and given that an air pressure is permanently maintained in the chamber 18 by means of the passages 7 and 19, it is clear that, from the initial position or rest position illustrated in FIG. 1, the admission of compressed air into the chamber 12 via the passage 5 will push the working piston 2 towards the right-hand side, thereby driving the auxiliary piston 16 towards the right as the air pressure inside the chamber 18 of the mount 14 increases (working position illustrated in FIG. 2).

Once the chamber 12 is exhausted via the passage 5, the pressure in the chamber 18 causes the piston 16, the working rod 1*a*–1*b* and hence the working piston 2 to return to the left until it reaches the rest position illustrated in FIG. 1. The permanent air pressure in the chamber 18 therefore acts as a pneumatic return spring for the working piston 2.

The air cylinder represented in FIGS. 3 to 5 comprises two working pistons 26 and 27 joined one to the other by a working rod 28 of a section designed accordingly and mounted so as to slide in the ends 29 and 30 of a cylindrical cylinder body 31, sealing being provided by lipped annular seals, 26*a* and 27*a*, 27*b* respectively. These ends 29 and 30 of the body 31 are closed off by a plug 32 with an exhaust hole 33 and by a plug 34 through which the rod 28 is inserted. In a bore or chamber 35 of the central part 36 of the cylinder body and on the rod 28, two return pistons 37 and 38, having a smaller section than those described above, are slidably mounted, and can bear respectively on the central part of the pistons 26 and 27. Rubber O-ring seals (not shown by reference numbers) provide a seal between the rod 28 and the cover 34 on the one hand and the pistons 37 and 38 on the other, as well as between these latter and the central part 36 of the body 31 along the wall of the chamber 35. The chamber 39 located to the right of the piston 27 may be placed in communication with a source of pressurised air or with atmospheric air via a duct 40 and with the chamber 41 located to the right of the piston 26 via an axial passage 42 of the rod 28, this passage opening laterally, at its ends, into these chambers 39 and 41. The chamber 43, separated from the chamber 39 by the piston 27, may also be placed in communication with a source of pressurised air or atmospheric air via an elbow passage 44 crossing through the central part 36 of the body 31 of the cylinder. Finally, the chamber 45, separated from the chamber 41 by the piston 26, is placed at atmospheric pressure by means of the hole 33 and the chamber formed by the bore 35 between the pistons 37 and 38 may be placed in permanent communication with a source of pressurised air via a passage opening into this chamber via an orifice 46.

This being the case and assuming, for example, that the working rod 28 is operatively linked to a tool such as a clamp with electrodes for spot-welding, initially assumed to be in a slightly open position (FIG. 3), the cylinder described above will operate in the following manner.

The chamber 43 is placed under pressure via the passage 44 causing the pistons 26 and 27 as well as the rod 28 to be displaced towards the right until a position is reached which corresponds to a wide open position of the clamp. The piston 26 pushes the small piston 37 towards the right but the small piston 38 is prevented from being displaced to the right as the head of this piston 38 comes into abutment against a stop b1 projecting into the bore 35. An over-pressure, equivalent to the compression of a return spring, is therefore created in the chamber 35 between the pistons 37 and 38 (FIG. 4).

The chamber 43 is then vented by means of the passage 44 and the over-pressure in the chamber 35 returns the piston 37 to its initial position, whilst the pistons 26 and 27 and the rod 28 return to their initial intermediate position corresponding to a slightly open welding clamp (FIG. 3).

Since the chamber 43 is still open to the ambient air, the compressed air is then fed via the duct 40 into the chamber 39 and via the axial passage 42 into the chamber 41, which causes the pistons 26 and 27 and the rod 28 to be displaced towards the left until they reach a working position corresponding to a clamping of the welding electrodes onto the workpiece at the desired force.

The displacement of the piston 27 towards the left causes the piston 38 to be displaced in the same direction but the piston 37 is prevented from being displaced as the head of this piston moves into abutment against a stop b2 projecting into the bore 35. An over-pressure is therefore created in the chamber 35 again between the pistons 37 and 38 (FIG. 5).

Then, when the pressure is released in the chambers 39 and 41 by placing the duct 40 at atmospheric pressure, the pressure which continues to prevail in the chamber 35 causes the piston 38 to be displaced towards the right and hence the return of the pistons 26 and 27 and the rod 28 to the right until they reach the intermediate position when the clamp is slightly open (FIG. 3). As can be seen, therefore, the pneumatic return device operates in the two directions in this case.

The invention is able to produce this result with independent sources of compressed air which branch into the duct 40 or the elbow passage 44 on the one hand and onto the orifice 46 on the other, the chamber 35 being subjected to a permanent pressure which is not the case of chambers 39, 41 and 43. The control logic can therefore be simplified.

Furthermore, the pneumatic return device has only a low inertia in a cylinder which is nevertheless capable of producing a very high clamping force whilst being of a reduced length and weight compared with a three-position cylinder which would produce an equivalent clamping force.

What is claimed is:

1. A cylinder with an elastic device for returning a working piston unit to a neutral position, this working piston unit being fixed onto a working rod and mounted so as to slide, in at least one working chamber, between a rest position and a working position, said neutral position being between the above two positions, the elastic device for returning said working piston to a neutral or intermediate position is of the pneumatic type and operates an auxiliary piston unit with a relatively small section, slidably mounted in an auxiliary chamber which is pneumatically supplied independently of that which operates said working piston unit, said elastic device has at least one auxiliary piston unit connected to said working piston unit and slidably mounted in an auxiliary chamber, this auxiliary piston unit being designed to be displaced inside said auxiliary chamber in one direction or the other by said working piston unit when the latter is displaced between its rest position and its working position, or vice versa, and to elastically compress a gas inside said auxiliary chamber so as to be able to return said working piston unit elastically to said neutral position, namely said rest position or said intermediate position, said working piston unit has two working pistons fixed onto a common working rod and in that it has, between the two working pistons, an auxiliary piston unit slidably mounted on the one hand on said working rod and on the other in an auxiliary chamber of a central part of a power cylinder, this auxiliary chamber being permanently subjected to a pneumatic pressure.

2. A cylinder as claimed in claim 1, characterised in that said auxiliary piston unit has two auxiliary pistons (37, 38) designed to project at two opposite ends of an auxiliary chamber (35) crossing through the power cylinder on either side of said central part (36) so as to be able to bear respectively on one and the other of said working pistons (26, 27) when these assume said neutral or intermediate position.

3. A cylinder as claimed in claim 2, characterised in that the displacements of said auxiliary pistons (37, 38) towards the respective ends of the auxiliary chamber (35) are limited by respective stops (b2, b1).

4. A cylinder as claimed in claim 3, characterised in that said central part (36) of the power cylinder has a passage (44) crossing through it, designed to place in communication with a source of pressurised fluid or to vent a first working chamber (43) bounded by a working piston (27), it also being possible to place the opposite working chamber (39) bounded by the same working piston (27) in communication with a source of pressurised fluid or to be vented by another duct (40).

5. A cylinder as claimed in claim 4, characterised in that said opposite working chamber (39) communicates with another working chamber (41) bounded by the other working piston (26) by means of an axial passage (42) of said working rod (28), the chamber (45) opposite the one above relative to said other working piston (26) being at outside pressure.

6. A cylinder as claimed in claim 5, characterised in that it is used to manoeuvre a welding clamp designed to occupy a neutral position or slightly open position, between a wide-open position and a position in which it is clamped on the workpieces to be welded.

7. A cylinder as claimed in claim 6, characterised by the following operating phases:

said first working chamber (43) is pressurised in order to displace said working pistons (26, 27) and the working rod (28) from said neutral or intermediate position with a slight opening (FIG. 3) to said wide-open position (FIG. 4) of the clamp, the pressurised gas in said intermediate chamber (35) then being compressed by a first auxiliary piston (37) whilst the second auxiliary piston (38) remains in abutment against a stop (b1);

said first working chamber (43) is vented and said working pistons (26, 27) and the working rod (28) are returned from said wide-open position (FIG. 4) to said neutral or intermediate position with a slight opening (FIG. 3) under the action of said first auxiliary piston (37), which is in turn subjected to the effect of the pressure in said auxiliary chamber (35), said first auxiliary piston (37) remaining in abutment against said other working piston (26) until it comes to a halt against a stop (b2);

said opposite working chamber (39) and said other working chamber (41) are placed under pressure in order to displace said working pistons (26, 27) and the working rod (28) from said neutral or intermediate position (FIG. 3) to said clamped position of the clamp (FIG. 5), the pressurised gas in said intermediate chamber (35) then being compressed by said second auxiliary piston (38) whilst the fist auxiliary piston (37) remains in abutment against said stop (b2);

said opposite working chamber (39) and said other working chamber (41) are vented and said working pistons (26, 27) and the working rod (28) are returned from said clamped position (FIG. 5) of the clamp to said neutral or intermediate position in which it is slightly open (FIG. 3) under the action of said second auxiliary piston (38), which is in turn subjected to the effect of the pressure in said auxiliary chamber (35), said second auxiliary piston (38) remaining in abutment against said working piston (27) until it comes to a halt against said stop (b1).

* * * * *